US009824505B2

(12) United States Patent
Tseng et al.

(10) Patent No.: US 9,824,505 B2
(45) Date of Patent: Nov. 21, 2017

(54) METHOD FOR TRIGGERING A VEHICLE SYSTEM MONITOR

(71) Applicant: Ford Global Technologies, LLC, Dearborn, MI (US)

(72) Inventors: Fling Tseng, Ann Arbor, MI (US); Imad Hassan Makki, Dearborn Heights, MI (US); Robert Roy Jentz, Westland, MI (US); Aed M. Dudar, Canton, MI (US); Dimitar Petrov Filev, Novi, MI (US); John Ottavio Michelini, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 64 days.

(21) Appl. No.: 14/189,778

(22) Filed: Feb. 25, 2014

(65) Prior Publication Data

US 2015/0243109 A1 Aug. 27, 2015

(51) Int. Cl.
*G07C 5/00* (2006.01)
*G07C 5/08* (2006.01)

(52) U.S. Cl.
CPC ..... *G07C 5/00* (2013.01); *G07C 5/0808* (2013.01)

(58) Field of Classification Search
CPC ..... B60W 2550/402; B60W 2530/14; B60W 2540/28; B60W 2540/30; B60W 40/09; B60W 10/08; B60W 10/26; B60W 2050/0088; B60W 20/00; B60W 2550/143; B60W 2550/308; B60W 50/20; F02D 41/221; F02D 41/0082; F02D 41/22; F02D 13/06; F02D 19/0689; F02D 41/0087; F02D 41/029; F02D 41/1454; F02D 41/222; Y02T 10/7005; Y02T 90/16; Y02T 10/18; Y02T 10/40; Y02T 10/705; Y02T 90/161;
(Continued)

(56) References Cited

U.S. PATENT DOCUMENTS 5,751,137 A 5/1998 Kiuchi et al.
6,446,614 B1 9/2002 Matsuoka et al.
(Continued)

FOREIGN PATENT DOCUMENTS

WO 2008127465 A1 10/2008
WO 2013072926 A2 5/2013

OTHER PUBLICATIONS

Anonymous, "A Quality Process for developing Diagnostic Systems and Strategies," IPCOM No. 000074334, Published Feb. 23, 2005, 3 pages.
(Continued)

*Primary Examiner* — Mussa A Shaawat
*Assistant Examiner* — Sanjeev Malhotra
(74) *Attorney, Agent, or Firm* — Julia Voutyras; McCoy Russell LLP

(57) ABSTRACT

Methods and systems are provided for improving the frequency of attempting and successfully completing one or more on-board diagnostic routines. Engine operating conditions are predicted based on a vehicle operator's driving pattern and routines are initiated if the predicted conditions match the conditions required for performing the routine. If the conditions do not match, entry and/or execution conditions of the routine are adjusted to better match the predicted conditions, so as to enable the routine to be attempted.

19 Claims, 7 Drawing Sheets

(58) Field of Classification Search

CPC ... Y02T 10/144; Y02T 10/47; Y02T 10/6217; Y02T 10/6221; Y02T 10/645; Y02T 10/7044; Y02T 10/72; Y02T 10/7283; Y02T 10/7291; Y02T 90/162; B60L 2240/622; B60L 11/1861; B60L 15/2045; B60L 2260/54; B60L 2260/56; B60K 6/46; B60K 6/48; F02B 37/00; G01C 21/3469; G06N 7/005; G06Q 10/10; G07C 5/00

USPC ... 701/1, 22, 26, 32.4, 48, 51, 96, 102, 105, 701/112, 114, 409, 532; 707/14.1; 60/277, 286, 609, 773; 123/299, 435, 123/692; 73/114.37, 114.73, 114.79; 706/13, 52; 455/418; 340/439; 320/136

See application file for complete search history.

(56) References Cited

U.S. PATENT DOCUMENTS 6,519,524 B2 2/2003 Ito
6,575,146 B1 6/2003 Kanai et al.
6,575,766 B1 6/2003 Xie et al.
6,609,051 B2 8/2003 Fiechter et al.
7,389,178 B2 6/2008 Raz et al.
7,447,459 B2 11/2008 Kitajima et al.
7,561,054 B2 7/2009 Raz et al.
7,562,559 B2 7/2009 Chung et al.
7,643,916 B2 1/2010 Underdal et al.
7,739,007 B2 6/2010 Logsdon
2003/0114965 A1* 6/2003 Fiechter ..... G06F 11/2263 701/29.3
2004/0088325 A1* 5/2004 Elder ..... G06Q 10/10
2005/0114012 A1* 5/2005 Zhu ..... F02D 41/22 701/114
2005/0119822 A1* 6/2005 Surnilla ..... F01N 11/002 701/114
2005/0228553 A1* 10/2005 Tryon ..... B60K 6/46 701/22
2006/0144038 A1* 7/2006 Miura ..... F01N 3/021 60/286
2007/0051351 A1* 3/2007 Pallett ..... F02D 17/02 123/692
2008/0119994 A1* 5/2008 Kameyama ..... B60W 40/08 701/48
2009/0055072 A1* 2/2009 He ..... F02D 41/0007 701/102
2010/0010732 A1* 1/2010 Hartman ..... G01C 21/3484 701/532
2010/0031738 A1* 2/2010 Feldkamp ..... G01M 15/042 73/114.79
2010/0070159 A1* 3/2010 Iwahashi ..... F02D 13/02 701/105
2010/0076913 A1* 3/2010 Yang ..... G06N 7/005 706/13
2010/0162718 A1* 7/2010 Bowman ..... F02C 9/28 60/773
2010/0175463 A1* 7/2010 Doering ..... F02D 13/06 73/114.37
2010/0199638 A1* 8/2010 Yoshikawa ..... F01N 3/0807 60/277
2010/0250089 A1* 9/2010 Buslepp ..... G01M 15/08 701/102
2011/0023590 A1* 2/2011 Van Nieuwstadt ... F02D 41/029 73/114.73
2011/0061629 A1* 3/2011 Goes ..... F02D 41/0082 123/435
2011/0132321 A1* 6/2011 Pursifull ..... F02D 41/0027 123/299
2011/0153532 A1* 6/2011 Kuge ..... B60W 40/09 706/12
2011/0202216 A1* 8/2011 Thai-Tang ..... B60W 10/08 701/22
2012/0186248 A1* 7/2012 VanDyne ..... F02B 37/105 60/609
2012/0253655 A1* 10/2012 Yamada ..... B60L 11/1861 701/409
2012/0316712 A1* 12/2012 Simonini ..... B60W 20/12 701/22
2013/0096731 A1 4/2013 Tamari et al.
2013/0231824 A1* 9/2013 Wilson ..... G05D 1/0246 701/26
2013/0335213 A1* 12/2013 Sherony ..... G08G 1/167 340/439
2013/0344859 A1* 12/2013 Abramson ..... G06Q 50/265 455/418
2014/0058596 A1* 2/2014 Martin ..... B60W 50/0205 701/22
2014/0201126 A1* 7/2014 Zadeh ..... G06K 9/627 706/52
2014/0266063 A1* 9/2014 Loftus ..... H02J 7/0016 320/136
2014/0288765 A1* 9/2014 Elwart ..... G01C 21/00 701/32.4
2014/0288799 A1* 9/2014 Elwart ..... B60W 40/09 701/96
2014/0343830 A1* 11/2014 Elwart ..... F02D 41/24 701/112
2014/0365087 A1* 12/2014 Jeon ..... F16H 61/0204 701/51
2015/0073620 A1* 3/2015 Matsumura ..... B60W 30/00 701/1

OTHER PUBLICATIONS

Anonymous, "Diagnostic Method of Identifying Sticking or Delayed Opening of Fuel Injectors," IPCOM No. 000126108, Published Jun. 30, 2005, 2 pages.

Anonymous, "Method to Improve OBDII EVAP Leak Monitor Robustness for Vehicle Dynamics and Road Conditions," IPCOM No. 000230023, Published Aug. 14, 2013, 2 pages.

Anonymous, "EVAP Leak Diagnostic for Vacuumless Engines," IPCOM No. 000233299, Published Dec. 5, 2013, 2 pages.

Anonymous, "Mitigation of EVAP Diagnostics Blocked Line DTC P144A," IPCOMM No. 000233303, Published Dec. 5, 2013, 2 pages.

Anonymous, "Vehicle Tow Detection for EVAP Monitor Robustness," IPCOM No. 000233591, Published Dec. 17, 2013, 2 pages.

Anonymous, "Fuel Vapor Evaporative System Vacuum Leak Testing With External Leak Agent," IPCOM No. 000234171, Published Jan. 15, 2014, 2 pages.

* cited by examiner

METHOD FOR TRIGGERING A VEHICLE SYSTEM MONITOR

FIELD

The present application relates to on-board diagnostic routines performed in vehicles, such as hybrid vehicles.

BACKGROUND AND SUMMARY

Vehicle systems may include monitors that perform various on-board diagnostic routines to check the health of the vehicle system. As an example, an emissions monitor may be mandated to periodically evaluate the functionalities of relevant systems, such as by diagnosing various sensors of the vehicle's engine system, diagnosing fuel system leak checks, assessing engine emissions triggers, etc. As such, each diagnostic routine performed by a monitor may have specific entry and/or execution conditions. These conditions may, in turn, be dependent on a plurality of variable parameters such as the vehicle or engine's operating conditions, energy storage conditions, customer usage of the vehicle, etc. In other words, the evaluations performed by the monitors may be trustworthy only when specified driving conditions and/or environmental conditions (the "entry and execution conditions") are met. However, due to the variability in vehicle conditions, the trigger and complete execution of a monitor's routines may not be guaranteed. For example, a routine may be initiated but aborted before completion due to execution conditions not being met. Alternatively, initiation of a routine may be delayed due to entry conditions not being met.

Various telematics based approaches have been developed to facilitate emissions compliance. For example, as shown by Fiechter et al. in U.S. Pat. No. 6,609,051, the use of machine learning and data mining technologies on data acquired from many vehicles is used for diagnostic applications. Therein, sensor data and information from on-board diagnostic systems are collected and monitored at an off-board site with data mining and data fusion algorithms applied for data evaluation. The data is also used to predict the state of a component.

However, the inventors herein have recognized that even with such approaches, a vehicle may be deemed non-compliant. For example, in addition to completion of the various diagnostic routines, emissions compliance of a vehicle may require the collection of high level statistics of the routines (e.g., the number of triggers, the number of full executions of a routine, the number of full executions that are flagged as pass, etc.). Regulatory agencies may conduct random sampling of the statistics and assess significant penalties if the results are not satisfactory. For example, penalties may be assessed if a monitor does not attempt a routine often enough, if the routine is aborted too often, if the routine is not flagged as pass often enough, etc. Thus, the approach of Fiechter may not sufficiently address at least the denominator component of accumulated monitor execution statistics that is subjected to government inspection.

In one example, some of the above issues may be at least partly addressed by a method for a vehicle having an engine comprising: initiating one or more on-board engine diagnostic routines based on predicted engine operating conditions, the prediction based on an operator's driving pattern. In particular, entry conditions for the one of more on-board engine diagnostic routines may be adjusted (e.g., temporarily relaxed) based on the predicted engine operating conditions. In this way, minimum monitor execution requirements may be met while also improving full execution of in-vehicle monitors.

As an example, frequent drive cycles of a vehicle operator may be evaluated with respect to the entry and execution conditions of one or more on-board diagnostic routines. In addition, habitual information may be gained by recursively learning driving patterns specific to the vehicle operator by using various in-vehicle sensors. Based on the data collected from the vehicle operator's driving patterns, future patterns of vehicle operation and expected engine operating conditions may be predicted. On-board diagnostic routines may then be initiated based on the predicted engine operating conditions. In particular, instead of triggering the execution of a diagnostic routine based on current engine operating conditions, the preview of future patterns may be assessed to determine if it may influence the trigger or inhibition of the routine. Thus, if the predicted operating conditions meet the entry and full execution conditions for a particular diagnostic routine, the given diagnostic routine may be initiated and completed more reliably. On the other hand, if the current conditions meet the entry requirements for a diagnostic routine but the predicted operating conditions indicate that full execution of the routine may not be possible, the vehicle controller may evaluate the risk associated with early abortion of the routine. If the penalty associated with early abortion of the routine is higher, the controller may temporarily prohibit entry of the diagnostic routine. In other examples, such as where there is a high risk or penalty associated with a routine being executed too infrequently, the entry and/or execution conditions of the routine may be adjusted, for example, temporarily relaxed. Relaxing the conditions may include making the requirements less stringent, such as, for example, by lowering the threshold for at least one parameter associated with the entry and execution conditions of the diagnostic routine. This may be achieved, for example, by increasing a vehicle speed range in which the diagnostic is enabled to run (or decreasing a vehicle speed range in which the diagnostic is not enabled to run).

In this way, statistical and stochastic models may be used to encapsulate a vehicle operator's driving pattern. Vehicle operating conditions may then be predicted based on the learned driving pattern. By adjusting the entry and execution of an on-board diagnostic routine based on the entry and execution conditions of the routine relative to the predicted vehicle operating conditions, the initiation and completion of diagnostic routines may be better enabled without reducing the credibility of the produced results. Likewise, by selectively relaxing the entry and execution conditions of a routine based on the predicted vehicle operating conditions, diagnostic routine completion numbers can be improved. Overall, accumulated monitor execution statistics can be improved by increasing both the denominator and the numerator. In addition, vehicle emissions compliance is better enabled.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
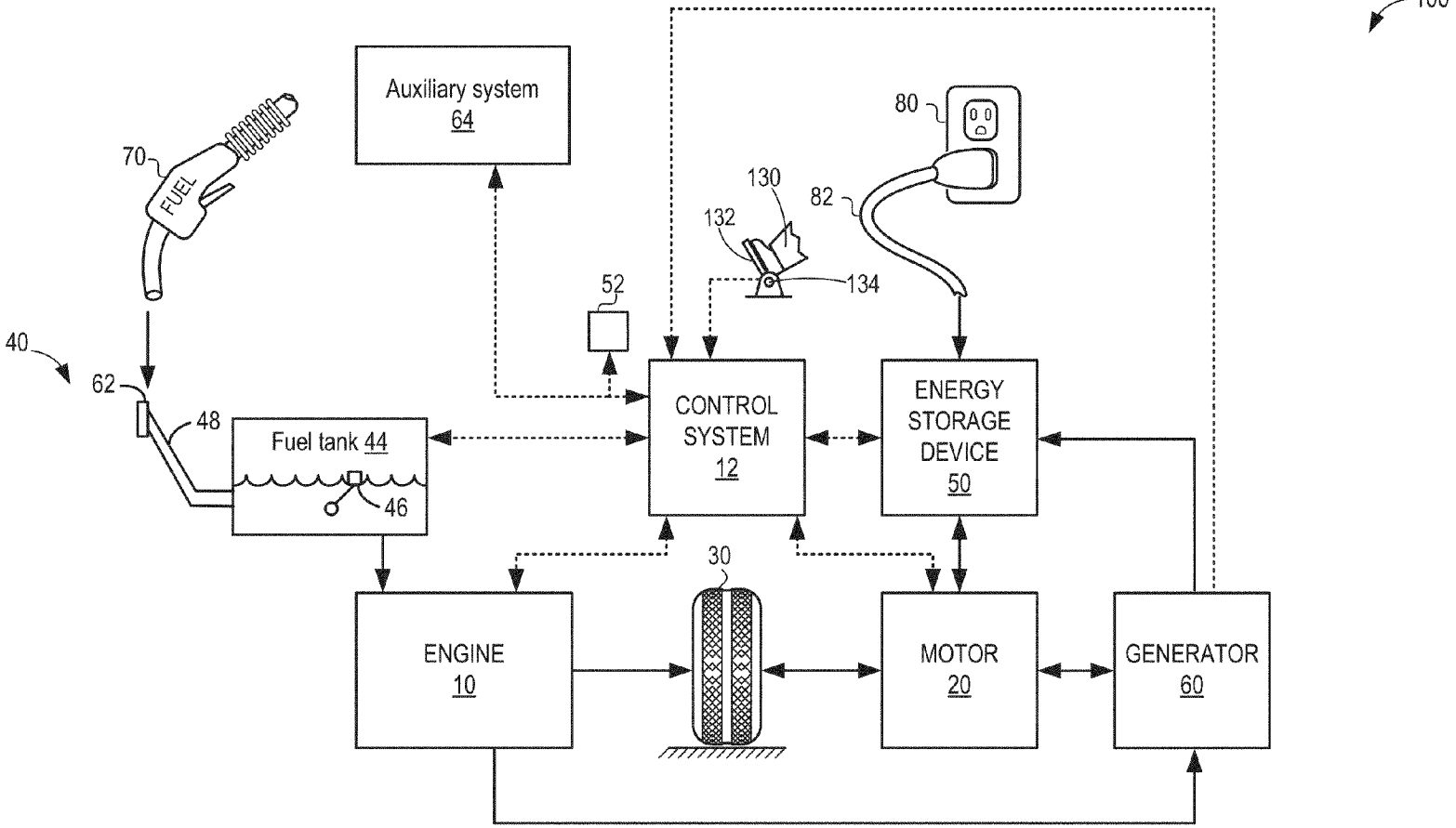
FIG. 1 illustrates an example vehicle system.
Figure 2:
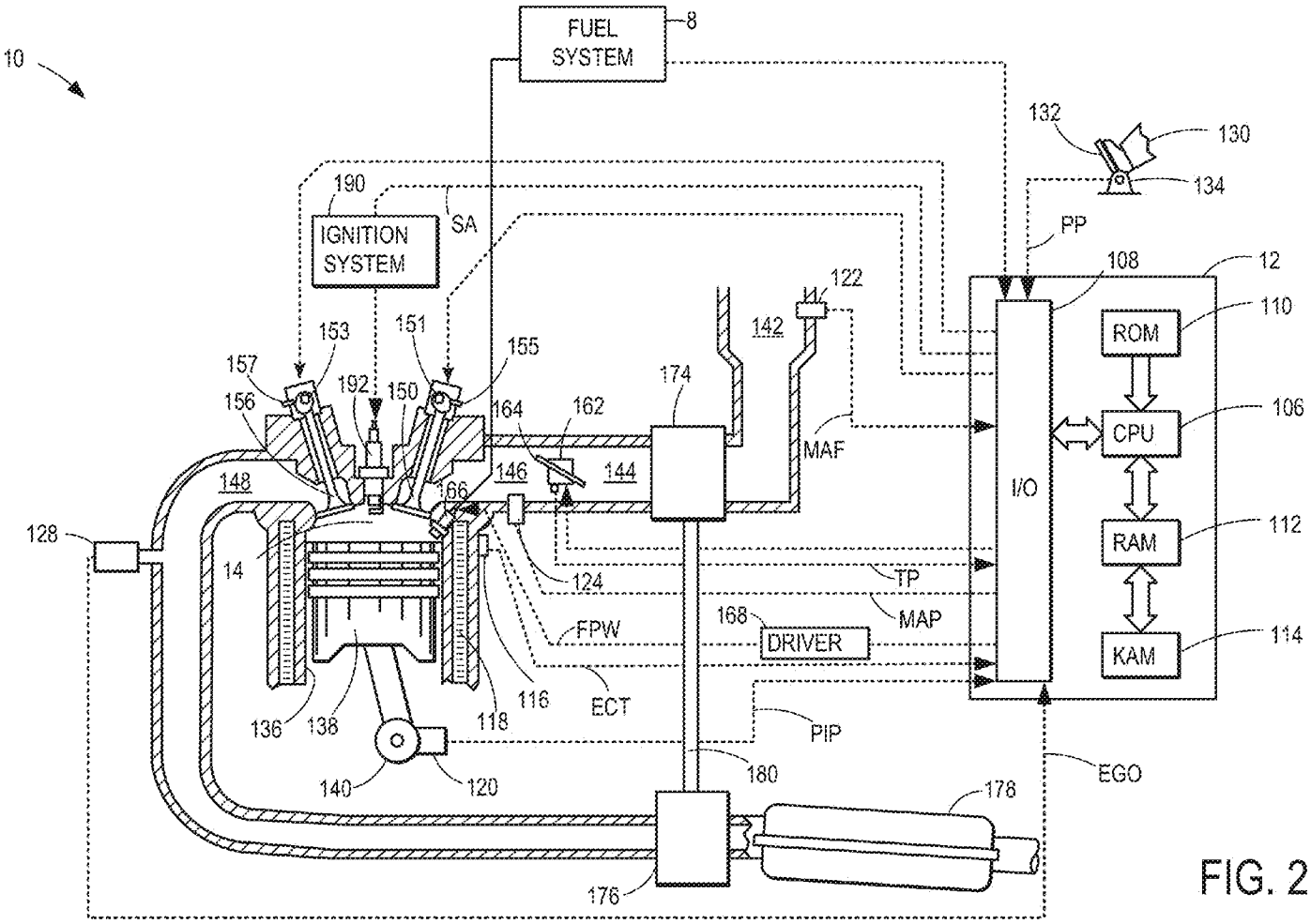
FIG. 2 illustrates an example internal combustion engine.

The following description relates to systems and methods for improving completion of on-board diagnostic routines in a vehicle system, such as the plug-in hybrid electric vehicle system of FIGS. 1-2. Various aspects of a vehicle operator's driving pattern may be learned over a number of vehicle drive cycles (FIGS. 4, and 6-8) and used to predict expected engine operating conditions. A vehicle controller may be configured to perform a control routine, such as the routine of FIG. 3, during vehicle operation to adjust initiation of an on-board diagnostic routine based on the predicted operating conditions. The controller may temporarily relax the entry and/or execution conditions of the diagnostic routine based on the predicted operating conditions (FIG. 5) so as to improve the completion rate of the diagnostic routine. In this way, vehicle emissions compliance may be improved.

FIG. 1 illustrates an example vehicle propulsion system 100. Vehicle propulsion system 100 includes a fuel burning engine 10 and a motor 20. As a non-limiting example, engine 10 comprises an internal combustion engine and motor 20 comprises an electric motor. Motor 20 may be configured to utilize or consume a different energy source than engine 10. For example, engine 10 may consume a liquid fuel (e.g. gasoline) to produce an engine output while motor 20 may consume electrical energy to produce a motor output. As such, a vehicle with propulsion system 100 may be referred to as a hybrid electric vehicle (HEV). Specifically, propulsion system 100 is depicted herein as a plug-in hybrid electric vehicle (PHEV).

Vehicle propulsion system 100 may be operated in a variety of different modes depending on vehicle operating conditions. Some of these modes may enable engine 10 to be maintained in an off state (or deactivated state) where combustion of fuel at the engine is discontinued. For example, under select operating conditions, motor 20 may propel the vehicle via drive wheel 30 while engine 10 is deactivated.

During other operating conditions, engine 10 may be deactivated while motor 20 is operated to charge energy storage device 50 via regenerative braking. Therein, motor 20 may receive wheel torque from drive wheel 30 and convert the kinetic energy of the vehicle to electrical energy for storage at energy storage device 50. Thus, motor 20 can provide a generator function in some embodiments. However, in other embodiments, a dedicated energy conversion device, herein generator 60 may instead receive wheel torque from drive wheel 30 and convert the kinetic energy of the vehicle to electrical energy for storage at energy storage device 50.

During still other operating conditions, engine 10 may be operated by combusting fuel received from fuel system 40. For example, engine 10 may be operated to propel the vehicle via drive wheel 30 while motor 20 is deactivated. During other operating conditions, both engine 10 and motor 20 may each be operated to propel the vehicle via drive wheel 30. A configuration where both the engine and the motor may selectively propel the vehicle may be referred to as a parallel type vehicle propulsion system. Note that in some embodiments, motor 20 may propel the vehicle via a first set of drive wheels and engine 10 may propel the vehicle via a second set of drive wheels.

In other embodiments, vehicle propulsion system 100 may be configured as a series type vehicle propulsion system, whereby the engine does not directly propel the drive wheels. Rather, engine 10 may be operated to power motor 20, which may in turn propel the vehicle via drive wheel 30. For example, during select operating conditions, engine 10 may drive generator 60, which may in turn supply electrical energy to one or more of motor 20 or energy storage device 50. As another example, engine 10 may be operated to drive motor 20 which may in turn provide a generator function to convert the engine output to electrical energy, where the electrical energy may be stored at energy storage device 50 for later use by the motor. The vehicle propulsion system may be configured to transition between two or more of the operating modes described above depending on operating conditions.

Fuel system 40 may include one or more fuel storage tanks 44 for storing fuel on-board the vehicle and for providing fuel to engine 10. For example, fuel tank 44 may store one or more liquid fuels, including but not limited to: gasoline, diesel, and alcohol fuels. In some examples, the fuel may be stored on-board the vehicle as a blend of two or more different fuels. For example, fuel tank 44 may be configured to store a blend of gasoline and ethanol (e.g. E10, E85, etc.) or a blend of gasoline and methanol (e.g. M10, M85, etc.), whereby these fuels or fuel blends may be delivered to engine 10. Still other suitable fuels or fuel blends may be supplied to engine 10, where they may be combusted at the engine to produce an engine output. The engine output may be utilized to propel the vehicle and/or to recharge energy storage device 50 via motor 20 or generator 60.

Fuel tank 44 may include a fuel level sensor 46 for sending a signal regarding a fuel level in the tank to control system (or controller) 12. Fuel level sensor 46 may comprise a float connected to a variable resistor, as shown. Alternatively, other types of fuel level sensors may be used. The level of fuel stored at fuel tank 44 (e.g. as identified by the fuel level sensor) may be communicated to the vehicle operator, for example, via a fuel gauge or indication lamp indicated at 52. Fuel system 40 may periodically receive fuel from an external fuel source. For example, in response to a fuel level in the fuel tank falling below a threshold, a fuel tank refill request may be made and the vehicle operator may stop the vehicle for refilling. Fuel may be pumped into the fuel tank from fuel dispensing device 70 via a refueling line 48 that forms a passageway from a refueling door 62 located on an outer body of the vehicle.

As such, vehicle system 100 may include various sensors and monitors that need periodic assessment. These may include, for example, a VCT monitor, an EGR monitor, an EGO sensor, a fuel monitor, an air-fuel ratio imbalance monitor, an FAOS sensor, as well as other routines such as leak detection routines. Periodic on-board diagnostic routines may be performed to confirm sensor/monitor functionality. To meet federal emissions requirements, on-board diagnostic (OBD) routines may need to be completed within a vehicle drive cycle. In addition, some of the OBD routines may need to be attempted at least a threshold number of times to enable monitor compliance. However, due to the limited engine running time in hybrid vehicles, a larger number of diagnostic routines may remain incomplete during regular engine operation. Likewise, due to unexpected variations in vehicle operating conditions from changes in ambient environment or operator driving behavior, diagnostic routines may be initiated but aborted early, or not even initiated. As such, vehicle emissions compliance requires the collection of high level statistics of the routines (e.g., the number of triggers, the number of full executions of a routine, the number of full executions that are flagged as pass, etc.). Government agencies may conduct random sampling of the statistics and assess significant penalties if the results are not satisfactory. For example, penalties may be assessed if a monitor does not attempt a routine often enough, if the routine is aborted too often, if the routine is not flagged as pass often enough, etc. As elaborated herein at FIGS. 3-5, to overcome these issues and enable a higher rate of diagnostic routine initiation and completion, diagnostic routines may be started based on predicted engine operating conditions, the conditions predicted based on learned operator driving behaviors and patterns. Thus, routines may be started if the predicted operating conditions match the execution conditions of the routine. Alternatively, the execution conditions may be temporarily relaxed to match those of the predicted operating conditions, allowing for the routine to be completed.

Control system 12 may communicate with one or more of engine 10, motor 20, fuel system 40, energy storage device 50, and generator 60. Specifically, control system 12 may receive feedback from one or more of engine 10, motor 20, fuel system 40, energy storage device 50, and generator 60 and send control signals to one or more of them in response. Control system 12 may also receive an indication of an operator requested output of the vehicle propulsion system from a vehicle operator 130. For example, control system 12 may receive feedback from pedal position sensor 134 which communicates with pedal 132. Pedal 132 may refer schematically to an accelerator pedal (as shown) or a brake pedal.

Energy storage device 50 may include one or more batteries and/or capacitors. Energy storage device 50 may be configured to store electrical energy that may be supplied to other electrical loads residing on-board the vehicle (other than the motor), including a cabin heating and air conditioning system (e.g., HVAC system), an engine starting system (e.g., starter motor), headlights, cabin audio and video systems, etc.

Energy storage device 50 may periodically receive electrical energy from an external power source 80 not residing in the vehicle. As a non-limiting example, vehicle propulsion system 100 may be configured as a plug-in hybrid electric vehicle (HEV), whereby electrical energy may be supplied to energy storage device 50 from power source 80 via an electrical energy transmission cable 82. During a recharging operation of energy storage device 50 from power source 80, electrical transmission cable 82 may electrically couple energy storage device 50 and power source 80. While the vehicle propulsion system is operated to propel the vehicle, electrical transmission cable 82 may be disconnected between power source 80 and energy storage device 50. Control system 12 may estimate and/or control the amount of electrical energy stored at the energy storage device, referred to herein as the state of charge (SOC).

In other embodiments, electrical transmission cable 82 may be omitted, where electrical energy may be received wirelessly at energy storage device 50 from power source 80. For example, energy storage device 50 may receive electrical energy from power source 80 via one or more of electromagnetic induction, radio waves, and electromagnetic resonance. As such, it should be appreciated that any suitable approach may be used for recharging energy storage device 50 from the external power source 80. In this way, motor 20 may propel the vehicle by utilizing an energy source other than the fuel utilized by engine 10.

As elaborated in FIG. 2, controller 12 may receive input data from various sensors, process the input data, and trigger various actuators in response to the processed input data based on instruction or code programmed therein corresponding to one or more routines. Example control routines are described herein with regard to FIGS. 3-5.

FIG. 2 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 2 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be disposed downstream of compressor 174 as shown in FIG. 2, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be estimated by one or more temperature sensors (not shown) located in exhaust passage 148. Alternatively, exhaust temperature may be inferred based on engine operating conditions such as speed, load, air-fuel ratio (AFR), spark retard, etc.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 150 and exhaust valve 156 may be determined by valve position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection (hereafter also referred to as "DI") of fuel into combustion cylinder 14. While FIG. 2 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12. It will be appreciated that, in an alternate embodiment, injector 166 may be a port injector providing fuel into the intake port upstream of cylinder 14.

As described above, FIG. 2 shows only one cylinder of a multi-cylinder engine. As such each cylinder may similarly include its own set of intake/exhaust valves, fuel injector(s), spark plug, etc.

Fuel tanks in fuel system 8 may hold fuel with different fuel qualities, such as different fuel compositions. These differences may include different alcohol content, different octane, different heat of vaporizations, different fuel blends, different fuel volatilities, and/or combinations thereof etc.

Controller 12 is shown in FIG. 2 as a microcomputer, including microprocessor unit 106, input/output ports 108, an electronic storage medium for executable programs and calibration values shown as read only memory chip 110 in this particular example, random access memory 112, keep alive memory 114, and a data bus. Storage medium read-only memory 110 can be programmed with computer readable data representing instructions executable by processor 106 for performing the methods and routines described below as well as other variants that are anticipated but not specifically listed. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; absolute manifold pressure signal (MAP) from sensor 124, cylinder AFR from EGO sensor 128, and abnormal combustion from a knock sensor and a crankshaft acceleration sensor. Engine speed signal, RPM, may be generated by controller 12 from signal PIP. Manifold pressure signal MAP from a manifold pressure sensor may be used to provide an indication of vacuum, or pressure, in the intake manifold.

Based on input from one or more of the above-mentioned sensors, controller 12 may adjust one or more actuators, such as fuel injector 166, throttle 162, spark plug 192, intake/exhaust valves and cams, etc. The controller may receive input data from the various sensors, process the input data, and trigger the actuators in response to the processed input data based on instruction or code programmed therein corresponding to one or more routines. Example control routines are described herein with regard to FIGS. 3-5.

Figure 3:
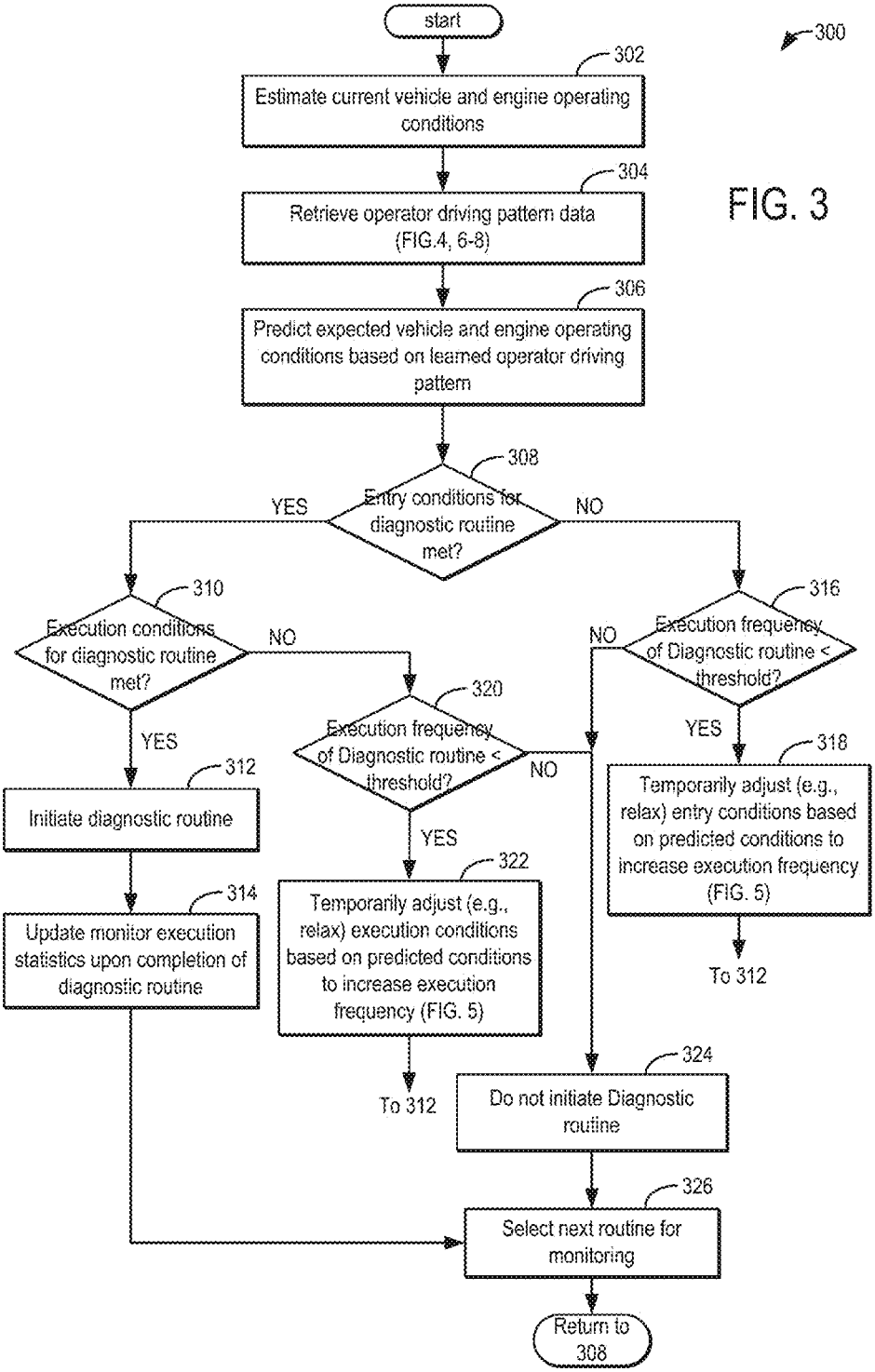
FIG. 3 illustrates a high level flow chart of a routine for initiating a diagnostic routine based on predicted engine operating conditions relative to entry and execution conditions of the diagnostic routine, the prediction based on a learned driving pattern of a vehicle operator.

Now turning to FIG. 3, an example method 300 is depicted for selectively initiating one or more on-board diagnostic routines based on predicted engine operating conditions during vehicle operation. In particular, during vehicle travel, the prediction is based on a learned driving pattern of a vehicle operator. The method enables a higher completion rate of on-board diagnostic routines, improving vehicles emissions compliance.

Figure 6:
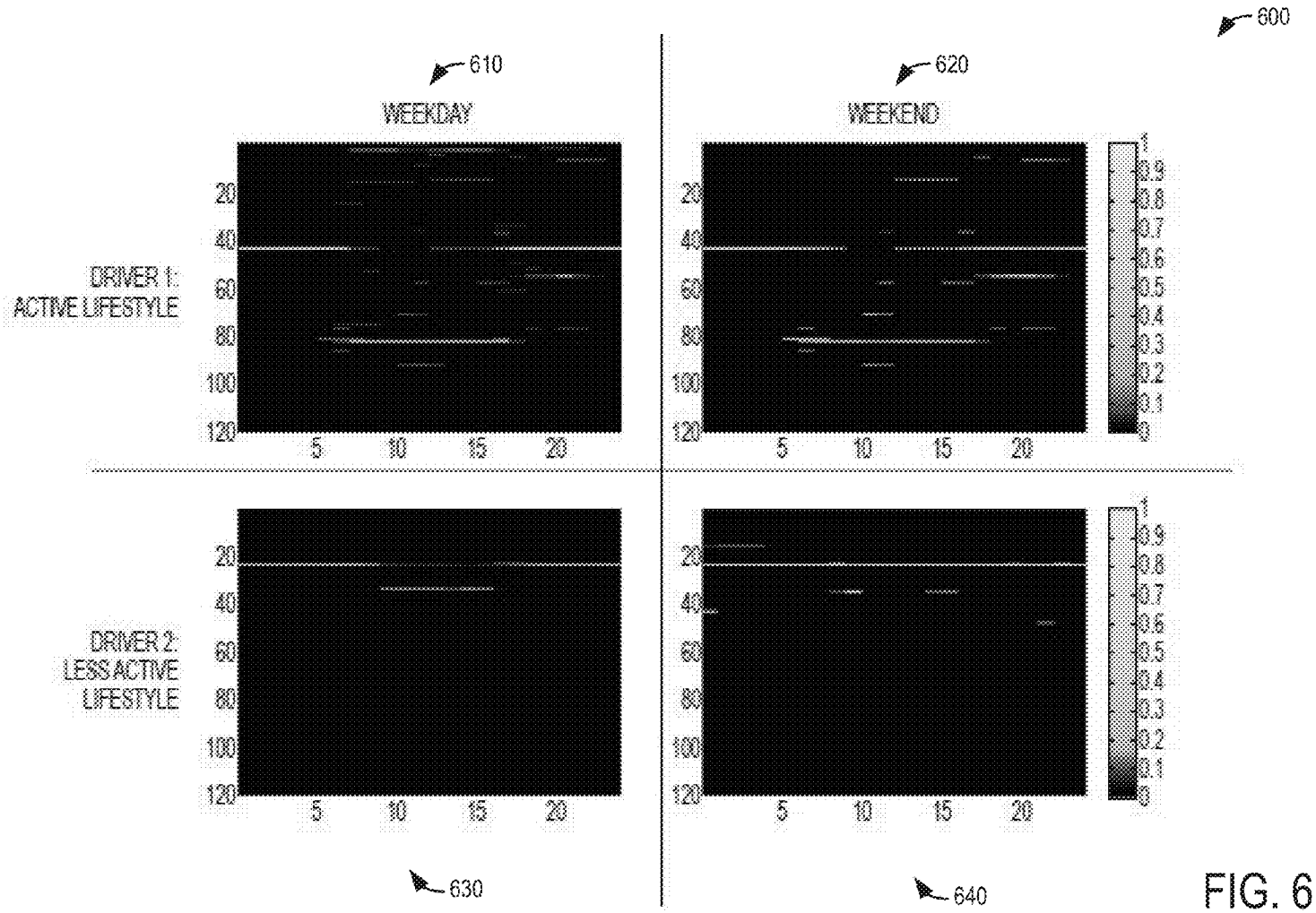
FIGS. 6-8 illustrate example approaches for learning different aspects of a vehicle operator's driving pattern.
Figure 7:
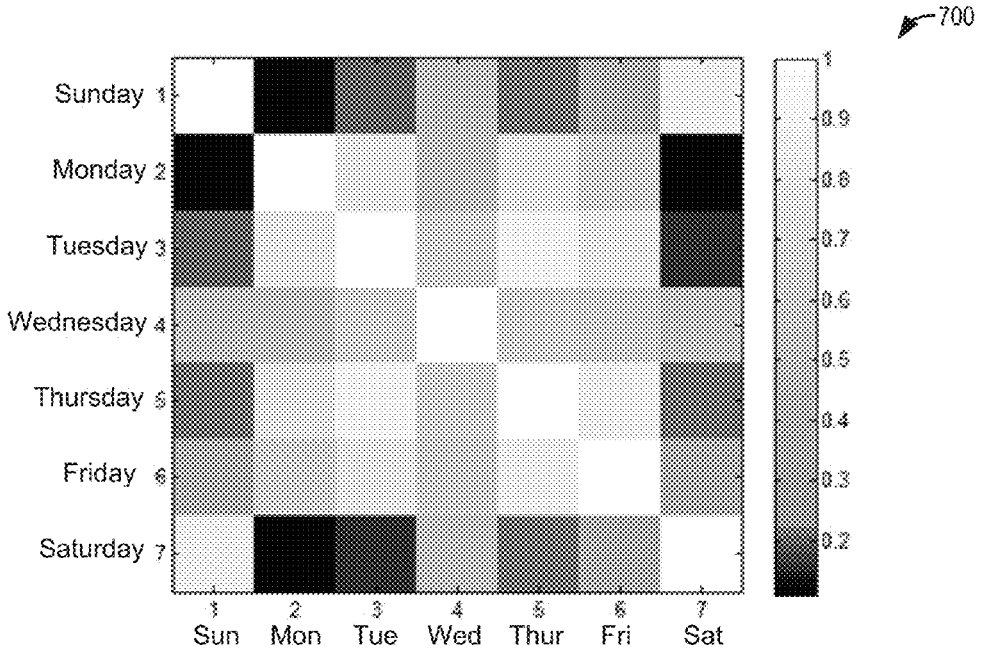
Figure 8:
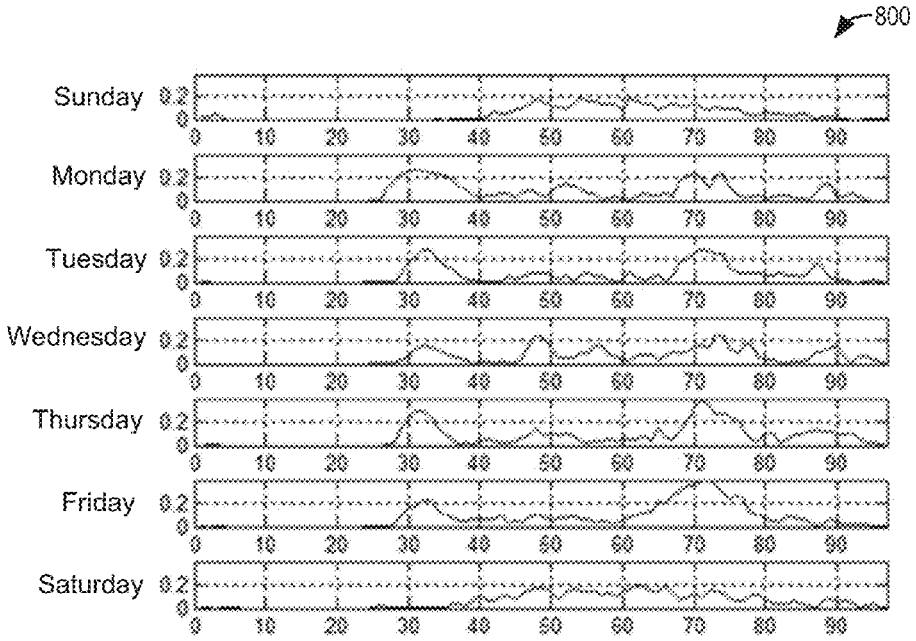

At 302, current vehicle and engine operating conditions may be estimated and/or measured. These may include, for example, engine speed, vehicle speed, engine temperature, ambient conditions (ambient humidity, temperature, and barometric pressure), boost level, exhaust temperature, manifold pressure, manifold air flow, battery state of charge, etc. At 304, details regarding an operator driving pattern may be retrieved from the controller's memory. As elaborated at FIG. 4, the learned driving pattern of the vehicle operator may be learned over a number of previous vehicle drive cycles based on one or more of frequent trip time patterns, habitual probability patterns, route based statistical profile, and environmental attribute profiles. Still other statistical profiles and aspects of a driver's driving behavior may be used. Example maps depicting the learning of various aspects of a driver's driving behavior are shown at FIGS. 6-8.

At 306, expected (e.g., upcoming) vehicle and engine operating conditions are predicted based on the learned operator driving pattern and behavior. For example, an expected vehicle speed profile, engine speed profile, engine temperature profile, etc., may be predicted based on the learned driving pattern of the vehicle operator. As elaborated below, during vehicle travel, the controller may selectively initiate one or more on-board diagnostic routines based on the predicted engine operating conditions. Specifically, the routines may be selectively initiated based on the predicted engine operating conditions relative to the entry and/or execution conditions of the diagnostic routine.

At 308, it may be determined if entry conditions for a given diagnostic routine are met. As such, the entry conditions refer to prerequisite operating conditions required for the diagnostic routine to be initiated. For example, if a diagnostic routine is run during steady state conditions, entry conditions may be met if there is no change in pedal position and further if the engine speed is below a threshold speed. As another example, if a diagnostic routine is run while the engine is off, entry conditions may be met if the hybrid vehicle is operating in an electric mode. As such, all the parameters of the entry conditions must be met for the entry conditions to be confirmed. In one example, the entry conditions may be matched to the current vehicle operating conditions (estimated at 302) to determine if entry conditions are met. Alternately, the entry conditions may be matched to the predicted vehicle operating conditions (estimated at 306) to determine if entry conditions are met.

If entry conditions are met, the method proceeds to 310 to determine if execution conditions for the given diagnostic routine are met. As such, the execution conditions refer to prerequisite operating conditions required for the diagnostic routine to be continued and completed. The execution conditions include prerequisite conditions of the routine that follow the entry conditions. For example, if the diagnostic routine is run during steady state conditions, execution conditions may be met if there is no change in pedal position and further if the engine speed remains below a threshold speed for the duration of the diagnostic routine. As another example, if a diagnostic routine is run while the engine is off, execution conditions may be met if the hybrid vehicle continues to operate in an electric mode for the duration of the diagnostic routine. As such, all the parameters of the execution conditions must be met for the execution conditions to be confirmed. In one example, the execution conditions may be matched to the current vehicle operating conditions (estimated at 302) to determine if execution conditions are met. Alternately, the execution conditions may be matched to the predicted vehicle operating conditions (estimated at 306) to determine if execution conditions are met. In still further examples, the entry conditions may be compared to the current engine operating conditions while the execution conditions may be compared to the predicted engine operating conditions for a controller to determine whether to initiate the diagnostic routine.

If entry and execution conditions are met, at 312, the method includes initiating the diagnostic routine is initiated. For example, if the predicted engine operating conditions match each of the entry and execution conditions of the diagnostic routine, the diagnostic routine is initiated. As another example, if the current engine operating conditions match the entry conditions and the predicted engine operating conditions match the execution conditions of the diagnostic routine, the diagnostic routine is initiated. At 314, upon completion of the diagnostic routine, execution statistics of the monitor may be updated in the controller's memory. The method may then move to 326 to identify another on-board diagnostic routine that can be initiated and completed during vehicle travel based on the current and predicted engine operating conditions. Accordingly, the method may return to 308 and assess entry and execution conditions for the selected routine.

Returning to 308, if entry conditions are not met based on current and/or predicted engine operating conditions, at 316, the method determines if the execution frequency of the diagnostic routine is lower than a threshold. Specifically, it may be determined if the diagnostic routine is a routine with a higher abortion risk. As such, there may be monitors that are at risk of being initiated and executed too few times. If such monitors are not attempted often enough, regulatory agencies sampling the data of on-board monitors may deem the results unsatisfactory and even assess significant penalties. Thus, if the routine is a high abortion risk routine, at 318, to improve the execution frequency and success rate of such monitors with reduced impact on the credibility of the generated results, the entry conditions of the diagnostic routine may be temporarily adjusted to enable initiation of the diagnostic routine.

Temporarily adjusting the entry conditions includes temporarily relaxing the entry conditions responsive to a change in the ambient environment of the vehicle or a change in the operator driving pattern so that the adjusted entry conditions better match the predicted engine operating conditions. As an example, temporarily adjusting the entry conditions of the diagnostic routine includes temporarily lowering a threshold of one or more parameters associated with the entry conditions of the diagnostic routine (e.g., one of vehicle speed and engine speed) while maintaining a threshold of remaining parameters associated with the entry conditions of the diagnostic routine (e.g., the other of vehicle speed and engine speed). In another example, individual thresholds for each parameter associated with the entry conditions of the diagnostic routine (e.g., each of vehicle speed and engine speed) may be directly modified (e.g., lowered). Temporarily adjusting the entry conditions of a diagnostic routine are elaborated herein with reference to FIG. 5. After temporarily adjusting the entry conditions of the routine, the method proceeds to initiate the diagnostic routine (at 312) and update monitor execution statistics upon execution of the routine (at 314). The method may then move to 326 to identify another on-board diagnostic routine that can be attempted during vehicle travel based on the current and predicted engine operating conditions. Accordingly, the method may return to 308 and assess entry and execution conditions for the next routine.

Returning to 316, if the routine is not a high abortion risk monitor, the method moves to 324 to not initiate the diagnostic routine. In other words, if the current and predicted engine operating conditions of a vehicle do not match the entry conditions of a diagnostic routine, and the penalty or risk associated with insufficient execution of the diagnostic routine is low, the routine may not be attempted. This allows the routine to be initiated only during conditions when there is a higher success rate of completion of the routine.

If entry conditions for the diagnostic routine are met at 308, but execution conditions are not met at 310, the method moves to 320 to determine if the execution frequency of the diagnostic routine is lower than a threshold. As was done at 316, it may be determined if the diagnostic routine is a routine with a higher abortion risk and if there is risk of vehicle emissions non-compliance due to insufficient attempts at completing the routine. If yes, then at 322, to improve the execution frequency and success rate of such monitors with reduced impact on the credibility of the generated results, the execution conditions of the diagnostic routine may be temporarily adjusted to enable initiation and execution of the diagnostic routine.

Temporarily adjusting the execution conditions includes temporarily relaxing the execution conditions responsive to a change in the ambient environment of the vehicle or a change in the operator driving pattern so that the adjusted execution conditions better match the predicted engine operating conditions. As an example, temporarily adjusting the execution conditions of the diagnostic routine includes temporarily lowering a threshold of one or more parameters associated with the execution conditions of the diagnostic routine (e.g., one of vehicle speed and engine speed) while maintaining a threshold of remaining parameters associated with the execution conditions of the diagnostic routine (e.g., the other of vehicle speed and engine speed). In another example, individual thresholds for each parameter associated with the execution conditions of the diagnostic routine (e.g., each of vehicle speed and engine speed) may be directly modified (e.g., lowered). Temporarily adjusting the execution conditions of a diagnostic routine are elaborated herein with reference to FIG. 5. After temporarily adjusting the execution conditions of the routine, the method proceeds to initiate the diagnostic routine (at 312) and update monitor execution statistics upon execution of the diagnostic routine (at 314). The method may then move to 326 to identify another on-board diagnostic routine that can be attempted during vehicle travel based on the current and predicted engine operating conditions. Accordingly, the method may return to 308 and assess entry and execution conditions for the selected routine.

Returning to 320, if the routine is not a high abortion risk monitor, the method moves to 324 to not initiate the diagnostic routine. In other words, if the current and predicted engine operating conditions of a vehicle do not match the execution conditions of a diagnostic routine, and the penalty or risk associated with insufficient execution of the diagnostic routine is low, the routine may not be attempted. This allows the routine to be attempted only during conditions when there is a higher success rate of completion of the routine. The method may then move to 326 to identify another on-board diagnostic routine that can be attempted during vehicle travel based on the current and predicted engine operating conditions. Accordingly, the method may return to 308 and assess entry and execution conditions for the next routine.

In this way, diagnostic routines may be selectively initiated based on predicted engine operating conditions relative to one or more of entry and execution conditions of the routines. For example, if the predicted engine operating conditions match one or none of the entry and execution conditions of the diagnostic routine, the controller may further estimate a difference or distance between the predicted engine operating condition and a desired engine operating condition (the entry or execution condition). If the estimated difference is less than a threshold difference, the controller may initiate the diagnostic routine. Else, if the estimated difference is more than the threshold difference, the controller may lower a threshold of at least one parameter associated with the entry and/or execution conditions of the diagnostic routine before initiating the diagnostic routine. In this way, the success rate of diagnostic monitors may be improved without affecting the reliability of their results.

Figure 4:
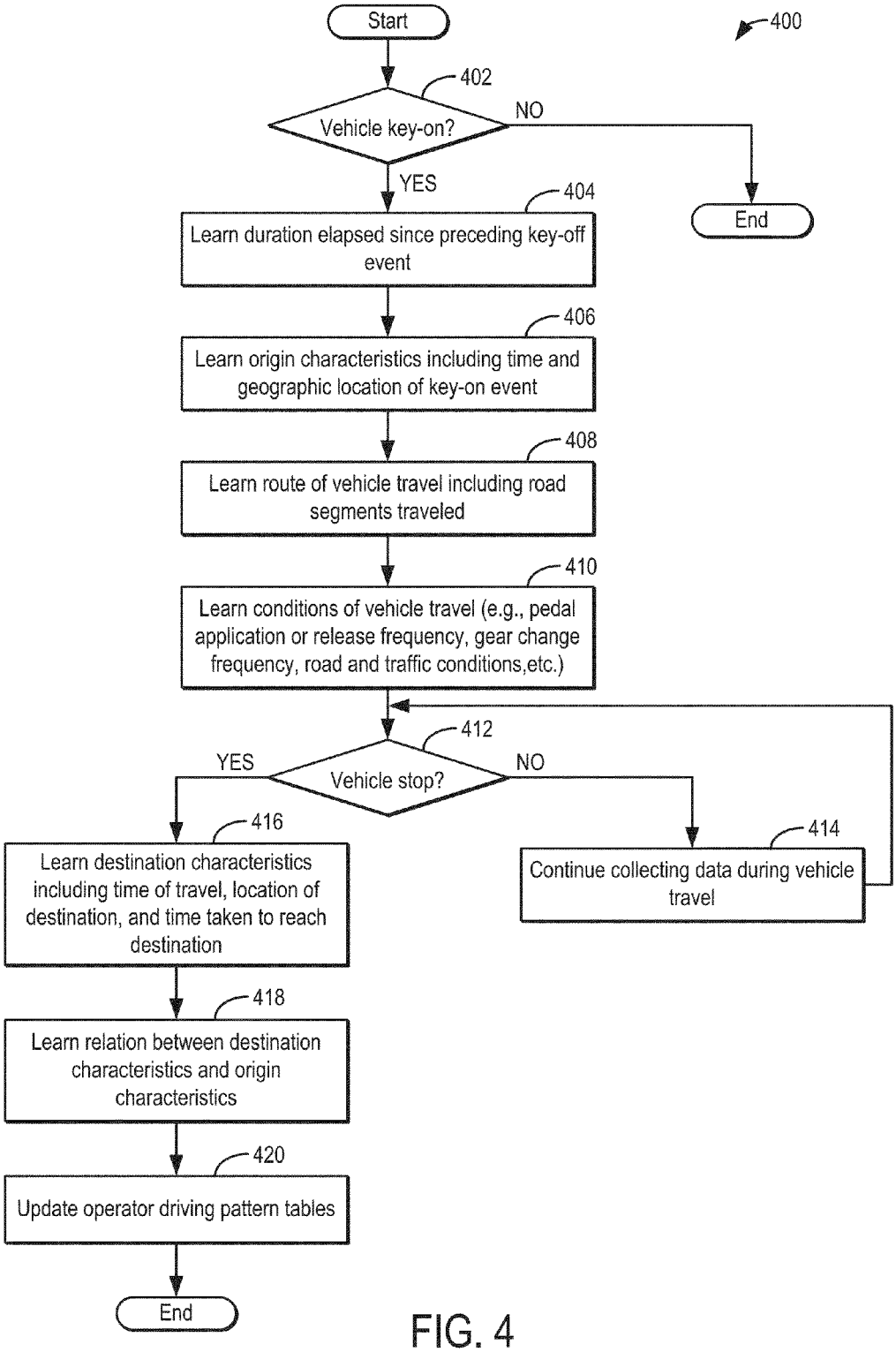
FIG. 4 illustrates a high level flow chart of a routine for learning a vehicle operator's driving pattern.
Figure 5:
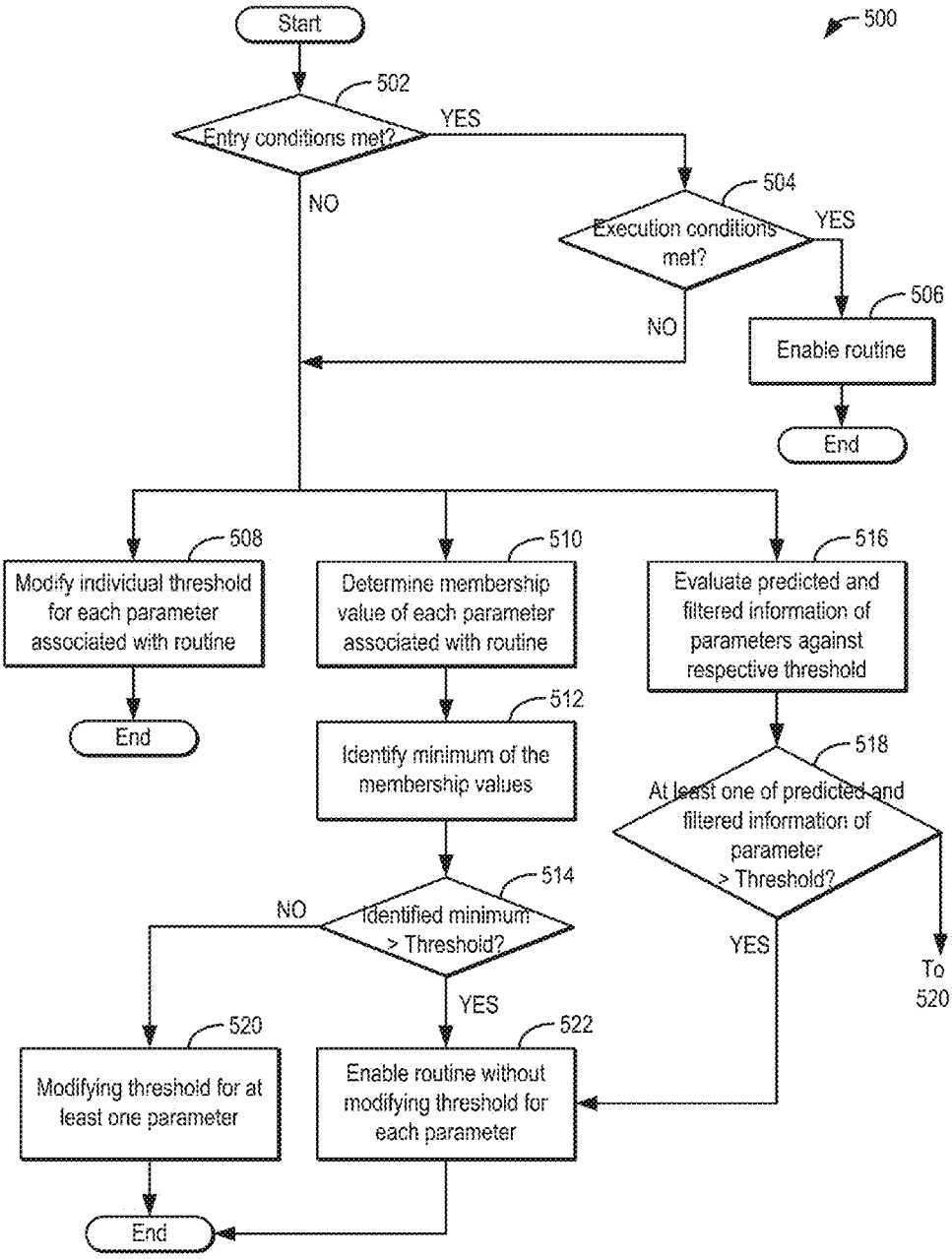
FIG. 5 illustrates a high level flow chart of a routine for temporarily relaxing entry and/or execution conditions for a diagnostic routine based on predicted engine operating conditions.

Now turning to FIG. 4, an example method 400 is shown for learning aspects of a vehicle operator's driving pattern or behavior. The learning may be performed over multiple vehicle drive cycles and stored in one or more look-up tables in the controller's memory. The stored data regarding the various aspects of the operator's driving pattern may then be used over a given drive cycle to better predict engine operating conditions. The predicted engine operating conditions may then be compared to entry and/or execution conditions of various vehicle monitors to improve the successful completion rate of the monitors.

At 402, a vehicle key-on event may be confirmed. For example, it may be determined that the vehicle operator has expressed intent to start vehicle operation. As such, by confirming a vehicle key-on event, an upcoming vehicle drive cycle is indicated. While referred to herein as a vehicle "key-on" event, it will be appreciated that the operator may indicate intent to operate the vehicle with or without the use of a key. For example, vehicle operation may be initiated by inserting a key (active key) into an ignition slot and moving the slot to an "ON" position. Alternatively, vehicle operation may be initiated when a key (passive key) is within a threshold distance of the vehicle (e.g., in the vehicle). As another example, vehicle operation may be initiated when the operator presses an ignition button to an "ON" position. Still other approaches may be used by an operator to indicate intent to operate the vehicle. As such, vehicle operator driving patterns may only be learned when the vehicle is operating. Thus, if a vehicle key-on event, and therefore an upcoming vehicle drive cycle, is not confirmed, the method may end and operator behavior may not be learned.

Upon confirming a vehicle key-on event, at 404, a duration elapsed since the immediately preceding key-off event may be determined. That is, a stopped duration of the vehicle may be estimated. At 406, the controller may learn origin characteristics including time and geographic location of the key-on event. For example, based on information from a vehicle navigation system (e.g., GPS device), the controller may determine the origin characteristics. The time may include a time of day when the vehicle is travelling, a date of travel, which day of the week the vehicle is travelling, etc. In this way, the controller may determine an amount of time the vehicle was stopped at a location (e.g., the point of origin) before beginning a trip.

At 408, the controller may learn details regarding a route of vehicle travel including road segments traveled. This may include a planned route of travel, an actual route of travel, and differences between the planned and actual route of travel. The details may be learned based on information from the vehicle navigation system. At 410, the controller may learn operating conditions of vehicle travel. These may include, for example, frequency of brake and accelerator pedal application, frequency of brake and accelerator pedal release, transmission gear change frequency, duration of operation in electric mode versus engine mode, road and traffic conditions, changes in vehicle speed and engine speed, etc.

At 412, it may be determined if vehicle operation has stopped. If not, at 414, the method may continue collecting data regarding various aspects of vehicle operation during vehicle travel. If a vehicle stop is confirmed, at 416, the method includes learning destination characteristics including time of travel from point of origin to destination, location of the destination, time taken to reach the destination, time of arrival at destination (including time of day, date, day of week and other details). At 418, the controller may learn relations between the destination characteristics and the origin characteristics. Specifically, correlations between various aspects of the vehicle operation may be learned so as to learn driving patterns and behaviors of the vehicle operator. At 420, based on the learned relationships and correlations, tables related to operator driving patterns may be populated and uploaded.

Example operator-specific driving patterns learned based on data collected over multiple drive cycles, the data pertaining to various aspects of vehicle travel, is shown at FIGS. 6-8.

Turning now to FIG. 6, learning of frequent trip time patterns in an operator's driving behavior is shown at 600 which includes a plurality of maps 610-640. The upper set of maps 610 and 620 depict stop time patterns on a weekday (map 610) and on a weekend day (map 620) for a first vehicle operator with a more active lifestyle. The lower set of maps 630 and 640 depict stop time patterns on a weekday (map 630) and on a weekend day (map 640) for a second vehicle operator with a less active lifestyle. In all maps, the x-axis depicts a 24 hour period during a day.

As such, for a trip or vehicle drive cycle, time element characterization considers at least a drive time and a stop time. The drive time represents the time it takes to go from a start location A to a destination B (A→B). The stop time represents the total time the vehicle is stopped at destination B before the beginning of the next trip to destination C (B→C).

Basic or simple characterization (for example, statistics) relevant to these time elements may include the learning of the average time it takes to go from A→B. For stop times, if the starting location is disregarded, a controller can learn the average amount of time the vehicle stays at B once it gets there.

In the plots, the y-axis depicts identified frequent locations with unique location IDs assigned for each learned frequent location. The horizontal lines in maps 610-640 depict stop times at different locations. Thus, as the length of the line increases, it indicates that the vehicle was stopped at that specific location for a longer time. As a position of the line changes along the y-axis, it depicts an alternate location. The shading of the lines indicates the probability of the vehicle being physically parked at the identified location. That is, the intensity of the lines indicate the relative likelihood of the vehicle being at that location. Thus, a brighter line indicates that the vehicle is more likely to be stopped at that location as compared to a location corresponding to a lighter line.

By comparing the lines, a controller may determine where the vehicle is likely to be at a given time of day. As such, the data is presented in an encoded manner such that the required information about vehicle stop times and locations at different times of day can be retrieved from maps 610-640 without requiring explicit details to be revealed.

In the depicted plots, if it is a weekday, the most visible locations are home and work (encoded by a unique number). For any row (representing a unique location), the stop duration and time to next key-on event can be estimated based on the plotted data.

In each map 610-640 of FIG. 6, the stop time patterns are arranged by different days of the week, time of the day and recognized frequent locations. Specifically, the top of plots 610 and 630 represents patterns for a Monday, while the bottom of plots 610 and 630 represent patterns for a Friday. The data in-between represents days between Monday and Friday. Likewise, the data on plots 620 and 640 represents Saturday and Sunday as the plot moves from top to bottom. For the different drivers, distinct patterns between a more active and less active life style can be seen upon comparing plot 610 to 630 (on a weekday) and comparing plot 620 to 640 (on a weekend). For example, one common theme for both drivers is that the majority of time is spent at home and office (work). In addition, the more active person tends to go to different places throughout the day.

As an example, map 610 indicates that approximately between hours 8 and 17 (that is, around 8 am to 5 pm), the vehicle operator with the more active lifestyle tends to be at the work location (brighter line). Before 8, the operator tends to be at the home location. After 17, the operator tends to be at the home location. The operator may also spend shorter intervals at one or more other locations before heading from the work location to the home location after 17. The operator also tends to have some variability in the time they leave for their work location (see lighter lines preceding bright lines starting around 8). In addition, this operator may spend shorter intervals at one or more other locations before heading from the home location to the work location before 8.

In comparison, map 630 indicates that vehicle operator with less active lifestyle tends to be at the work location more regularly from 9 to 4. Before 9 and after 4, the operator tends to be at the home location. In addition, this operator tends to not make too many variations in time of departure from work or home. This operator also tends not to head to locations other than work and home.

As another example, map 620 indicates that the vehicle operator with the more active lifestyle tends to travel to multiple locations on the weekend while map 640 indicates that the vehicle operator with the less active lifestyle tends to stay at home more on the weekend.

The information gathered from the stop time patterns may then be used to predict vehicle operating conditions and determine whether or not to initiate a diagnostic monitor. As one example, based on the stop time patterns, it may be determined that the vehicle operator with the more active lifestyle (plot 610) tends to drive to a first location (e.g., from home to work) at a first time of day on weekdays (e.g., around 8) and stops there for more than a threshold amount of time (e.g., more than 15 mins). The operator also tends to drive to a second location (e.g., from home to a coffee shop) at a second, different time of day on weekdays and stops there for less than the threshold amount of time. Thus, for a particular monitor that takes at least 18 minutes to be run, if all entry conditions are met, it is highly likely that the execution of the monitor will be able to successfully finish a sequence of testing procedures if the monitor is initiated when the operator is at the first location. However, the same data also indicates that based on the predicted vehicle operating conditions and expected vehicle stop time, it is highly likely that the execution of the monitor will not be completed if the monitor is initiated when the operator is at the second location. This is due to early abortion of the monitor due to the next key-on event. The monitor may have a higher abortion risk and/or a higher penalty associated with non-completion of the diagnostic routine. Thus, to improve the success rate of the monitor, the controller may disable initiation of the diagnostic routine when the vehicle is at the second location even if all the entry conditions are met based on predicted vehicle operating conditions indicating that execution conditions (in this case, execution time) will not be met.

In another example, a monitor may be executed in roughly 10 minutes on average. In addition, the monitor may have a lower abortion risk and/or a lower penalty associated with non-completion of the diagnostic routine. Thus, it may be deemed acceptable for certain entry conditions of the monitor to be relaxed to a small degree without compromising the precision and reliability of the test results. A controller may determine that this monitor can be executed if the routine is initiated when the operator is at the first or the second location with high confidence that the necessary testing sequences will be fully executed without early abortion due to the next key-on event. For example, if the monitor's entry conditions usually require engine temperature to be above a first (higher) threshold, the controller may allow the monitor to be initiated when the vehicle is at the first or second location if the engine temperature is above a second threshold, lower than the first threshold.

Turning now to FIGS. 7 and 8, maps 700 and 800 depict learning of operator habitual probability patterns including key-on probabilities and weekday-weekend correlations for a given vehicle operator. In particular, map 700 depicts learning of correlations between the 7 days of the week while map 800 depicts learning of key-on probabilities. As such, additional habitual information can be gained by recursively learning probabilities using in-vehicle sensors.

Map 700 is a graphical representation of a 7×7 correlation matrix of 7 days of the week for a given operator. In the map, data is plotted for Sunday through Saturday along the y-axis going from top to bottom, and from Sunday through Saturday along the x-axis going from left to right. The grayscale reference chart on the right indicates the correlation values, with brighter shades indicating higher correlations and darker shades indicating lower correlations. For example, white indicates highest similarity while black indicates lowest similarity, and the shades of grey there-between indicate varying degrees of similarity there-between. The highest value of 1 (brightest shade or white shading) is guaranteed across the diagonal by simply saying that Monday is equivalent of Monday, Tuesday is equivalent of Tuesday and so forth.

By looking at the vehicle key-on signal, a probability curve can be learned inferring the similarities of different days of the week in a driver's driving behavior. For this particular vehicle operator, the data indicates that Sunday and Saturday are highly correlated. The data further indicates that while Monday is more similar to Tuesday and Thursday, and less similar to Wednesday and Friday, Monday is also very different from Saturday and Sunday. The correlation between different days enables the aggregation of information to yield data with more reliable patterns.

Map 800 of FIG. 8 depicts learning of key-on probabilities for a given vehicle operator's driving behavior with the plots depicting the days Sunday through Saturday going from the top plot to the bottom plot. The map further depicts the 24 hours throughout a day going from left to right on the x-axis (depicted herein as 0 to 100). Each peak represents a likelihood of a key-on event. Thus a higher peak at a given time of day indicates a higher likelihood of a key-on event at that time of day. The dashed horizontal line (at around 0.2 on the y-axis) corresponds to a threshold above which a key-on event is confirmed. Thus, if a peak height exceeds the threshold, the controller may learn that the operator has keyed-on the vehicle with the intent to travel. As with FIG. 7, the data in FIG. 8 is presented such that the distribution of plots gives the desired information in a compressed format without giving the specific details of where exactly the vehicle is being operated to. As such, plot 800 provides additional information regarding the likelihood of whether a vehicle driver might key-on again to start a trip. By looking at the vehicle key-on signals, a duration of vehicle operation on any given vehicle drive cycle can be learned for different days of the week in a driver's driving behavior. As an example, for this particular vehicle operator, the data indicates that there is a higher likelihood of the vehicle being keyed-on around Sam (around the 30 mark on the x-axis) on weekdays, in particular on Mondays, Tuesdays and Fridays, as compared to the weekend. The vehicle is also more likely to be keyed-on around 5 pm (around the 70 mark on the x-axis) on weekdays. The data further suggests that the vehicle is maintained key-on for a longer duration on any given vehicle drive cycle on weekdays as compared to the weekend. The data further indicates that the vehicle is keyed-on more frequently on Mondays and Fridays.

As such, by comparing the data of maps 600 and 800, the controller may determine where the vehicle operator is travelling to. For example, assuming the data of FIG. 8 corresponds to the same vehicle operator as the data of maps 630 and 640, it may be determined that when the vehicle operator keys on the vehicle at Sam on a Monday, the operator will be travelling from the home location to the work location (the operator's most likely destination on Monday mornings). Likewise, it may be determined that when the vehicle operator keys on the vehicle at 5 pm on a Monday, the operator will be travelling from the work location to the home location (the operator's most likely destination on Monday evenings).

Based on the data collected at maps 700 and 800, a controller may determine whether to trigger a critical monitor and/or whether to adjust entry/execution conditions for the monitor. As an example, for a monitor that needs at least 1-hour to guarantee its full execution without any interruption, the controller may use the collected data and the sum of the next 1 hour from the time (time of day and day of week) the monitor's entry conditions are confirmed to evaluate the likelihood a key-on event might occur. As an example, if the monitor's entry conditions are met on a Monday afternoon, the controller may determine that it is highly likely that a key-off event will not occur for the next 1-hour, and may allow the monitor to be triggered. In another example, if the monitor's entry conditions are met on a Saturday afternoon, the controller may determine that it is highly likely that a key-off event will occur within the next 1-hour, casing the monitor to be aborted. In view of this prediction, the controller may not allow the monitor to be triggered, even though entry conditions are met.

As such, still other route or road based statistical attributes and statistical drive or environmental attribute profiles may be used in addition to the maps of FIGS. 6-8 to learn various aspects of an operator's driving pattern. These may then be used by a controller with the data of FIGS. 6-8 to predict engine operating conditions and whether to initiate a monitor. For example, information may be collected during recurrent drive events taking place on frequently traveled roadways or routes. These may be correlated with driving times and driving conditions to better predict engine operating conditions.

To accumulate recurrent information taking place on frequent roadways, three main mechanism may be put in place. The first mechanism may include Route Segmentation/Representation. At least two types of segments can be obtained. The first includes a map provider's database definition. Therein, all map providers have their map database in place where all road segments are defined based on proprietary protocols. These segments tend to be smaller in terms of distance in order for them to incorporate various road geometric information enabling full reconstructions of a detailed map not only for display but also for other purposes. The second segment includes Self-discovery and management. Therein, continuous availability of navigational information (such as GPS information) from a mobile device, including a vehicle, enables preservation of navigational information through linear/non-linear compression algorithms that may be tunable depending on resolution requirement. Some compression methods enable the incorporation of attributes of interest to be spontaneously compressed. When the number of attributes to be included in the database is small, much higher compression ratios (more compact representation of the same dataset) could be obtained suitable for onboard storage.

The second mechanism used to accumulate recurrent information taking place on frequent roadways may include frequent trips/route recognition. Assuming segmentation information is obtained either through on-board learning or from a map provider, a pass or non-pass vector for the same trip (that is, same start and same destination) can be obtained during driving and uniquely different alternatives can be obtained. In general, destination and routes prediction (including alternatives) goes hand in hand since knowing one of them doesn't present enough information about the upcoming trip.

The third mechanism used to accumulate recurrent information taking place on frequent roadways may include segment based knowledge or statistics learning and accumulation. Assuming road segmentation information is available, knowledge accumulation can take place in the following, predefined sequence. First, attribute data cluster(s) are identified. Cluster identification could be performed in real-time with novelty detection methods or using existing algorithms such as KNN or Mountain clustering. Following cluster identification, assignment/updating of active data clusters is performed. As such, cluster assignment deals with comparing currently observed data with exiting prototypical data (the clusters). The outcome is either the update (learning) of an existing cluster or creation of a new one if no match was identified. Following cluster assignment, learning of overall or conditional activation frequencies is performed. As such, activation frequencies can be learned using a low pass filter with clearly defined conditions. When done properly, given current conditions, the next probable states can be predicted with statistical attributes learned through clustering.

As an example, data related to the operator's driving patterns may be collected to learn different routes taken by the vehicle operator for a given trip (that is, when travelling from the same point of origin to the same destination). The different routes may be learned as a function of different checkpoints that the vehicle passes. The different routes may be selected by the operator based on the time of day, day of week, etc. For example, on certain weekdays (e.g., a Monday), the vehicle operator may take a shorter route in the morning when travelling from the home location to the work location. On other weekdays (e.g., Wednesday), the vehicle operator may take a longer route (e.g., via a preferred coffee shop) in the morning when travelling from the home location to the work location. Based on the time taken to the destinations and checkpoints, the controller may determine whether there is sufficient time to initiate a monitor. For example, assuming entry conditions are met, a monitor is more likely to be completed on a Monday morning while the same monitor may be aborted due to an interrupting key-on or key-off event on a Wednesday when the operator stops at the checkpoint. Based on the route selected, the controller may learn to not initiate the monitor on a Wednesday if the alternate route is selected by the operator. However, if the operator selects the primary (direct) route on a Wednesday, the monitor may be initiated. In other examples, entry conditions for a monitor may be adjusted or relaxed based on the route preference.

In still other examples, the operator driving patterns may include learning of traffic patterns. The traffic patterns may be learned as a function of the trip, as well as the time of day, day of week, etc. Clustering methods may be used to learn the traffic patterns and may be correlated with the route preference and other driving aspects of the operator. The compiled data may then be used by the controller to determine whether to initiate a monitor while reducing the risk of early monitor abortion. Likewise, the compiled data may be used to temporarily relax entry conditions for a monitor so as to enable better completion statistics. Now returning to FIG. 5, an example method 500 is shown for temporarily adjusting entry and/or execution conditions for an on-board diagnostic routine based on engine operating conditions. The prediction may be based on a learned driving pattern of a vehicle operator, as discussed at FIG. 4 and FIGS. 6-8. It will be appreciated that the method of FIG. 5 may be performed during selected vehicle operating conditions. That is, the temporary adjusting of entry and/or execution of the diagnostic routine may be performed only during a first set of (vehicle operating) conditions the entry and/or execution conditions not adjusted during a second, different set of (vehicle operating) conditions.

At 502, it may be determined if entry conditions for a given diagnostic routine have been met. For example, it may be determined if the predicted engine operating conditions match the entry conditions of the given diagnostic routine. Alternatively, it may be determined if the current engine operating conditions match the entry conditions of the given diagnostic routine. If yes, the method determines at 504 if the execution conditions for the given diagnostic routine have been met. For example, it may be determined if the predicted engine operating conditions match the execution conditions of the given diagnostic routine. If the predicted engine operating conditions match both the entry and execution conditions of the diagnostic routine, at 506, the method enables performing of the routing.

If the predicted engine operating conditions do not match at least one of the entry conditions and the execution conditions, the method proceeds to temporarily adjust the entry conditions and/or the execution conditions of the routine. The entry and/or execution conditions may be adjusted based on the predicted operating conditions so as to provide a better match. For example, the controller may temporarily adjust the entry conditions based on the predicted engine operating conditions not matching the entry conditions of the routine at 502. As another example, the controller may temporarily adjust the execution conditions based on the predicted engine operating conditions not matching the execution conditions of the routine at 504.

The temporary adjusting may be performed via various options. A first example option is described at 508, a second example option is described at 510-514, and a third example option is described at 516-524. As such, these are non-limiting examples and still other adjustments may be possible.

As a first example, at 508, the method directly modifies the individual threshold of each parameter associated with the entry or execution conditions of the diagnostic routine. For example, the threshold for each parameter may be temporarily relaxed or lowered. The lowering may be based on the difference between the unmatched entry or execution condition and the predicted engine operating conditions. For example, as the difference increases, the threshold may be lowered more. In one example, the entry or execution conditions for the diagnostic routine may include a vehicle speed being higher than 40 mph and an engine speed being higher than 1000 rpm. If the predicted engine operating conditions include a vehicle speed of 32 mph and an engine speed of 900 rpm, the threshold for both the vehicle speed and the engine speed may be lowered. For example, the threshold for the vehicle speed may be lowered to 30 mph and that of the engine speed may be lowered to 800 rpm so that the entry and execution conditions can be met.

It will be appreciated that in an alternate example, the individual threshold of each modifiable parameter associated with the entry or execution conditions of the diagnostic routine may be modified. As such, these may be parameters that have a lower impact on the performance of the monitor. There may be other parameters that have a higher impact on the performance of the monitor and whose thresholds are not modifiable. These parameters may require thresholds and conditions to be strictly followed. For example, while the threshold for vehicle speed and engine speed is modifiable (and may be modified at 508), the thresholds for battery power limits and actuator state may not be modifiable (and may not be modified at 508). After the diagnostic routine is completed, the unadjusted thresholds may be resumed.

As another example, at 510, the method may include determining individual membership values for each parameter associated with the routine based on the predicted engine operating conditions. The membership values may represent a similarity of the parameter value (at the predicted conditions) to a desired value (the entry or execution conditions). As such, the membership values may be used to evaluate the operating conditions instead of hard thresholds. At 512, the method may identify a minimum of the membership values. For example, if the routine has n parameters, each with individual membership values Mem_1, Mem_2 . . . Mem_n, then the minimum may be determined as Min(Mem_1, Mem_2, . . . Mem_n). At 516, the method may compare the identified minimum membership value to a predefined threshold. The threshold may be based on the risk or penalty associated with insufficient execution of the diagnostic routine. Thus, if the diagnostic routine is a routine with a higher abortion risk and a larger penalty associated with the insufficient completion of the routine, the minimum membership value may be compared to a lower threshold. Else, if the diagnostic routine is a routine with a lower abortion risk and a smaller penalty associated with the insufficient completion of the routine, the minimum membership value may be compared to a higher threshold.

In an alternate example, after determining individual membership values for each parameter associated with the routine based on the predicted engine operating conditions, the controller may determine an aggregate membership value for the routine based on the combination of each of the determined individual membership values. The aggregate membership value may then be compared to the threshold value.

If the minimum membership value (or the aggregate membership value) is higher than the threshold value, at 522, the method may intrusively initiate the diagnostic routine without adjusting the entry or execution conditions even if the predicted engine operating conditions do not match the entry or execution conditions of the routine. That is, if the predicted engine operating conditions do no absolutely match the entry or execution conditions of the monitor, but the deviations of the individual parameters of the entry or execution conditions are within a threshold of the corresponding values of the predicted engine operating conditions, the monitor may be enabled without relaxing or modifying the entry or execution conditions of the diagnostic routine, and despite the deviation in absolute values.

If the minimum membership value (or aggregate membership value) is lower than the threshold value, at 520, the method includes modifying, for example, relaxing or lowering, the threshold for at least one parameter associated with the diagnostic routine. The at least one parameter selected for modification may be selected based on the individual membership value of the parameter. For example, if a deviation of the individual membership value of a parameter from the desired membership value of the corresponding parameter in the entry or execution conditions of the routine is higher than a predefined amount, the threshold for that parameter may be relaxed or lowered. Likewise, as the deviation increases, the threshold for the given parameter may be lowered further. It will be appreciated that while the above example suggests lowering the threshold to temporarily relax the conditions, in alternate examples, the threshold may be alternately modified to temporarily relax the conditions. As such, after the diagnostic routine is completed, the unadjusted thresholds may be resumed.

It will be further appreciated that the parameters selected for modification may be further selected based on their impact on the performance of the monitor. Thus, parameters may be selected for threshold modification if their impact on the performance of the monitor is lower, while parameters with a higher impact on the performance of the monitor may not be selected for threshold modification. The parameters having a higher impact may have thresholds that are more strictly maintained. In other words, parameters selected for modification (based on their membership values) may be selected from a superset of parameters that have modifiable thresholds. For example, while the threshold for vehicle speed and engine speed for a given diagnostic routine may be modified, the thresholds for battery power limits and actuator state may not be modified.

In one example, temporarily lowering a threshold for at least one parameter associated with the unmatched entry or execution conditions of the diagnostic routine may include lowering the threshold for all the parameters having a membership value lower than the corresponding predefined threshold values. The threshold for the at least one parameter may be lowered until the predicted engine operating conditions meet the unmatched entry or execution conditions. For example, the thresholds may be modified until the deviation of the membership value of the parameter and the desired membership value is lower than a threshold amount.

As an example, there may be two parameters (vehicle speed and engine speed) of the entry/execution conditions to check for the diagnostic routine to be enabled. The desired conditions for the routine to be enabled may includes vehicle speed higher than 40 mph (vspd>40 mph) and engine speed higher than 1000 rpm (engine_spd>1000 rpm). Thus, the desired or threshold membership values for the parameters may be Mu=40 for vehicle speed and Mu=1000 for engine speed. If the predicted engine operating conditions include vspd=38 mph, and engine_spd=1035 RPM, then the individual membership values of the parameters may be determined to be vspd_threhold_membership_value=0.8825; and engine_spd_threhold_membership_value=1 (since it is larger than Mu of threshold_engine_spd). The minimum of these two values is 0.8825. If the threshold of the aggregated membership value is set to be 0.85, then the determined minimum membership value is higher than the threshold (0.85<0.8825), and the entry/execution conditions may be determined to be passed even if not all criteria are fully met. The monitor may then be attempted without adjusting the thresholds even though the predicted conditions do not exactly match the required entry/execution conditions.

In an alternate example, if the threshold of the aggregated membership value is set to be 0.90, then the determined minimum membership value is lower than the threshold (0.90>0.8825), and the entry/execution conditions may be determined to be not passed. The monitor may then be attempted only after adjusting the thresholds. The monitor may then be performed. After the diagnostic routine is completed, the unadjusted thresholds may be resumed.

A third example is now shown at 516. Herein, predicted engine operating conditions and/or filtered information for the parameters associated with the monitor may be evaluated against respective thresholds. For example, instead of current vehicle speed, filtered vehicle speed information such as an aggregation of past vehicle speed information in a moving window may be evaluated against the vehicle speed threshold. At 518, it may be determined if the predicted and filtered information associated with at least one parameter of the routine is higher than a corresponding threshold. If yes, the method moves to 522 to enable the routine to be performed without modifying the threshold of the given parameter. Else, if the information is lower than the threshold, then the method moves 520 to lower or relax the threshold for the given parameter.

In one example, during operation of a hybrid electric vehicle, in response to current engine operating conditions matching entry conditions for a diagnostic routine but predicted future engine operating conditions not matching execution conditions for the diagnostic routine, a controller may temporarily relax the execution conditions for the routine to enable completion of the diagnostic routine during vehicle operation. The temporary relaxing may include temporarily lowering the threshold for at least one parameter of the execution conditions of the routine. The temporary lowering may further include lowering the threshold until the predicted engine operating conditions match the adjusted execution conditions; and after the diagnostic routine is completed, resuming the unadjusted threshold. The at least one parameter may be selected based on a difference between a state of the parameter in the predicted engine operating conditions and a state of the parameter in the execution conditions being higher than a threshold difference.

In this way, various attributes of a vehicle operator's driving pattern may be learned statistically or stochastically. By learning attributes such as frequency of trips, key-on and key-off probabilities, road and route based driving profiles, environmental attribute profiles, etc., upcoming vehicle operating conditions may be predicted more reliably and accurately. This in turn allows the triggering of on-board monitors to be adjusted based on the predicted driving conditions so that the success rate of the monitor is improved. For example, monitors can be triggered when they are more likely to be completed. Further, the entry and/or execution conditions of the monitor can be temporarily modified based on their deviation from the predicted vehicle operating conditions so that the monitor can be triggered and completed more successfully. The entry and/or execution conditions of only selected parameters may be adjusted under selected conditions so that the credibility of monitor results generated using adjusted entry conditions is not impacted. By selectively relaxing the entry and execution conditions of a routine based on the predicted vehicle operating conditions, diagnostic routine initiation and completion statistics can be increased, improving vehicle emissions compliance.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle, comprising:

during vehicle operation, selectively initiating an on-board diagnostic routine based on predicted engine operating conditions relative to entry conditions of the onboard diagnostic routine, the entry conditions including a vehicle speed threshold, the prediction based on a learned driving pattern of a vehicle operator, the selectively initiating including:

when the predicted engine operating conditions match the entry conditions, initiating the on-board diagnostic routine responsive to vehicle speed higher than the vehicle speed threshold;

when the predicted engine operating conditions do not match the entry conditions, lowering the vehicle speed threshold, and initiating the on-board diagnostic routine responsive to vehicle speed higher than the lowered vehicle speed threshold; and wherein the selectively initiating further includes temporarily adjusting the one or more of the entry conditions and execution conditions to enable initiation of the on-board diagnostic routine.

2. The method of claim 1, wherein during vehicle operation includes during vehicle travel, and wherein the selectively initiating is further based on the predicted engine operating conditions relative to execution conditions of the on-board diagnostic routine.

3. The method of claim 2, wherein the selectively initiating further includes, if the predicted engine operating conditions match each of the entry conditions and execution conditions of the on-board diagnostic routine, initiating the on-board diagnostic routine; and if the predicted engine operating conditions match one of the entry conditions and execution conditions, delaying initiation of the on-board diagnostic routine.

4. The method of claim 1, wherein the temporarily adjusting is responsive to a change in ambient environment or a change in operator driving pattern.

5. The method of claim 1, wherein the temporarily adjusting includes temporarily lowering a threshold of one or more parameters associated with one or more of the entry conditions and execution conditions of the on-board diagnostic routine while maintaining a threshold of remaining parameters associated with the one or more of the entry conditions and execution conditions of the on-board diagnostic routine.

6. The method of claim 1, wherein the learned driving pattern of the vehicle operator includes on one or more of frequent trip time patterns, habitual probability patterns, route based statistical profiles, and environmental attribute profiles.

7. The method of claim 2, wherein the selectively initiating further includes, if the predicted engine operating conditions match one or none of the entry conditions and execution conditions of the on-board diagnostic routine, estimating a difference between the predicted engine operating conditions and a desired engine operating condition;

if the estimated difference is less than a threshold difference, initiating the on-board diagnostic routine; and if the estimated difference is more than the threshold difference, lowering a threshold of at least one parameter associated with one or more of the entry conditions and execution conditions of the on-board diagnostic routine before initiating the on-board diagnostic routine.

8. The method of claim 1, wherein the on-board diagnostic routine is a routine with a higher abortion risk.

9. A method for a vehicle, comprising:

during vehicle travel, initiating an on-board diagnostic routine if entry conditions of the on-board diagnostic routine are met; and if the entry conditions are not met and predicted engine operating conditions match the entry conditions, enabling initiation of the on-board diagnostic routine by temporarily adjusting the entry conditions for the on-board diagnostic routine based on the predicted engine operating conditions, the predicted engine operating conditions based on a learned driving pattern of a vehicle operator; and if the entry conditions are not met and predicted engine operating conditions do not match the entry conditions, not initiating the on-board diagnostic routine.

10. The method of claim 9, wherein the temporarily adjusting the entry conditions includes the temporarily adjusting only during a first set of predicted engine operating conditions, and not adjusting during a second, different set of predicted engine operating conditions, the method further comprising adjusting execution conditions for the on-board diagnostic routine based on the predicted engine operating conditions.

11. The method of claim 10, wherein adjusting the execution conditions based on the predicted engine operating conditions includes adjusting the execution conditions based on the predicted engine operating conditions not matching the execution conditions of the on-board diagnostic routine.

12. The method of claim 11, wherein the temporarily adjusting the entry conditions includes temporarily lowering a threshold for one or more parameters associated with the unmatched entry conditions or the unmatched execution conditions of the on-board diagnostic routine, the one or more parameters including a vehicle speed and an engine speed.

13. The method of claim 12, wherein the threshold for the one or more parameters is lowered until the predicted engine operating conditions meet the unmatched entry conditions or the unmatched execution conditions.

14. The method of claim 12, wherein the threshold is a first threshold, and wherein the temporarily adjusting entry conditions includes:

determining individual membership values for each of the one or more parameters associated with the on-board diagnostic routine based on the predicted engine operating conditions;

determining an aggregate membership value for the on-board diagnostic routine based on a combination of each of the determined individual membership values;

comparing the aggregate membership value to a second threshold based on the entry conditions and/or the execution conditions of the on-board diagnostic routine; and if the aggregate membership value is lower than the second threshold, lowering the first threshold for at least one parameter of the one or more parameters of the on-board diagnostic routine, the at least one parameter selected based on the individual membership value of the at least one parameter, the lowering of the first threshold also based on the individual membership value of the at least one parameter.

15. The method of claim 14, further comprising, if the aggregate membership value is higher than the second threshold, intrusively initiating the on-board diagnostic routine without adjusting the first threshold for the at least one parameter even if the predicted engine operating conditions do not match the entry conditions or the execution conditions of the on-board diagnostic routine.

16. A method for a hybrid vehicle, comprising:

during vehicle operation, in response to current engine operating conditions matching entry conditions for a diagnostic routine but predicted future engine operating conditions not matching execution conditions for the diagnostic routine, temporarily relaxing the execution conditions for the diagnostic routine based on a time of day, a day of week, and an operator route preference, to enable completion of the diagnostic routine during vehicle operation; and wherein selectively initiating further includes temporarily adjusting the one or more of the entry conditions and execution conditions to enable initiation of the on-board diagnostic routine.

17. The method of claim 16, wherein the temporarily relaxing includes temporarily lowering a threshold for at least one parameter of the execution conditions of the diagnostic routine.

18. The method of claim 17, wherein the temporarily lowering includes lowering the threshold until the predicted future engine operating conditions match the adjusted execution conditions; and after the diagnostic routine is completed, resuming the unadjusted threshold, wherein the at least one parameter is selected based on a difference between a state of a parameter in the predicted future engine operating conditions and a state of the given parameter in the execution conditions being higher than a threshold difference.

19. The method of claim 16, further comprising not initiating the diagnostic routine if the current engine operating conditions do not match entry conditions and the predicted future engine operating conditions do not match the entry conditions.

* * * * *